United States Patent [19]

Blake

[11] Patent Number: 4,955,511

[45] Date of Patent: Sep. 11, 1990

[54] TRIGGER ACTUATED PUMP AND METHOD OF MAKING SAME

[76] Inventor: William S. Blake, 14 Georgetown Ct., Linwood, N.J. 08221

[21] Appl. No.: 286,072

[22] Filed: Dec. 19, 1988

Related U.S. Application Data

[63] Continuation-in-part of Ser. No. 248,418, Sep. 23, 1988.

[51] Int. Cl.[5] ..... B67D 5/00

[52] U.S. Cl. ..... 222/321; 222/341; 222/383; 239/333

[58] Field of Search ..... 222/340, 341, 383, 309, 222/79, 384, 385, 320, 321; 239/333

[56] References Cited

U.S. PATENT DOCUMENTS

| | | | |
|---|---|---|---|
| 3,840,157 | 10/1974 | Hellenkamp | 222/385 X |
| 4,225,061 | 9/1980 | Blake et al. | 222/383 X |
| 4,606,480 | 8/1986 | Gazulla | 222/383 X |
| 4,624,413 | 11/1986 | Corsette | 222/383 X |
| 4,728,009 | 3/1988 | Schmidt | 222/383 X |
| 4,815,663 | 3/1989 | Tada | 222/383 X |

FOREIGN PATENT DOCUMENTS

| | | | |
|---|---|---|---|
| 2041339 | 9/1980 | United Kingdom | 222/383 |

*Primary Examiner*—Kevin P. Shaver
*Assistant Examiner*—Boris Milef
*Attorney, Agent, or Firm*—Dennis H. Lambert

[57] ABSTRACT

An inexpensive, disposable trigger actuated pump in which the shroud and nose piece are molded as a single unit. In one form of the invention, the pump housing is molded as a single unit with the shroud and nose piece, and a trigger actuator and piston pump are also molded as a single unit for subsequent assembly with the shroud, housing and nose piece unit, return spring, nose valve, dip tube and container to form a completed pump. The trigger actuated pump of the invention thus comprises fewer parts than conventionally manufactured pumps, thereby reducing inventory requirements and assembly steps and consequently reducing the manufacturing costs, enabling the pump to be disposed of after the contents of the container are emptied.

19 Claims, 4 Drawing Sheets

TRIGGER ACTUATED PUMP AND METHOD OF MAKING SAME

This application is a continuation-in-part of copending application Ser. No. 248,418 filed Sept. 23, 1988.

FIELD OF THE INVENTION

This invention relates generally to fluid dispensing pumps of the type which are applied to a container and manually operated to dispense product from the container. More particularly, the invention relates to an improved trigger sprayer shroud and method of making same, in which the number of parts is reduced and assembly is simplified, thereby reducing cost.

DESCRIPTION OF THE PRIOR ART

Many different pump constructions are known in the prior art for dispensing a variety of products, including a variety of trigger actuated sprayers. Prior art trigger actuated pumps typically comprise separately molded housings, shrouds, nose pieces, trigger actuators and pumps, and associated springs and valving members. Many such trigger designs incorporate twelve or more separately molded parts, making assembly relatively complicated and expensive and necessitating inventory of a large number of small parts. Moreover, the use of many separate parts joined together renders such prior art pump designs susceptible to breakage, and the molding techniques used in making them generally require that the nose piece and nozzle configuration be made as a separate part which is then assembled to the trigger housing or shroud. Many prior art triggers are also designed for reuse and are therefore relatively expensive to make.

SUMMARY OF THE INVENTION

Accordingly, it is an object of this invention to provide a trigger actuated pump which comprises a minimum number of parts, simplifying assembly and reducing manufacturing costs.

Another object of this invention is to provide a trigger actuated pump in which the nose piece is integrally molded with the shroud, thereby facilitating assembly and reducing the number of parts which must be inventoried.

A further object of the invention is to provide a trigger actuated pump in which the number of separately molded parts is reduced from twelve to five.

Yet another object is to provide an improved molding technique for molding the shroud and nose piece of a trigger actuated pump, in which a retractable core for molding the nose piece is movable in the core for the shroud, both of which are controlled by a horn pin or similar mechanism to achieve the same operation.

Another object is to provide a trigger actuated pump which is inexpensive to make and may be applied to a container for use and then disposed of when the contents of the container are emptied.

These and other objects of the invention are achieved by a novel structure and process, in which the shroud and nose piece of a trigger actuated pump are integrally molded as a single part. In one form of the invention, the shroud, nose piece and housing are all integrally molded together for subsequent assembly with a nose piece valve, one-piece trigger actuator and pump, return spring and dip tube. A second form of the invention provides for integral molding of the shroud and nose piece as a single part for subsequent assembly with a pump housing, actuator, return spring and dip tube. In the first form of the invention, the nose piece, as molded, is displaced 180° about an integral hinge to enable retraction of the mold core and is then pivoted into operative relationship with the shroud/housing during assembly. In the second form of the invention one molding technique uses a "fixed" core for molding the shroud, and a slidable core is carried by the "fixed" core for molding the nose piece, both of the cores being controlled by a horn pin during the opening and closing movement of the mold. With this approach, the nose piece is molded in its operative position. A second approach molds the nose piece in a 90° displaced position, requiring pivoting of the nose piece into operative position during assembly.

Assembly of the first form of the invention is carried out with a minimum number of steps. In the first step, a nose piece valve is inserted into the nose piece while the nose piece remains in its "as molded" position, and a return spring is seated in the pump housing. The trigger actuator and pump unit is then inserted into the pump housing against the return spring and fully depressed in the housing, followed by pivoting of the nose piece into operative position over the front of the trigger and pump unit. The nose piece is held in its operative position by interengaged snap detents on the nose piece and shroud. A dip tube is then attached to the shroud/housing, and the assembled pump is secured to a container.

The invention thus provides a simplified manufacturing technique, involving fewer parts and easier assembly, with reduced costs and inventory requirements. The resulting trigger actuated pump is also stronger and less susceptible to breakage and/or disassembly than prior art constructions. Moreover, depending upon the requirements of a particular vendor, the elements of the various trigger designs of the invention could be interchanged with one another to produce a desired result. For instance, the nose piece of the first form of the invention need not be molded in a 180° displaced position, but could be displaced only 90° during molding, for example, or different nose valve configurations could be used in lieu of that shown in the drawings. Similarly, other changes could be made to suit particular requirements, and the specific structures and procedures described herein need not be strictly followed in order to produce a trigger actuated pump having the advantages of the invention.

BRIEF DESCRIPTION OF THE DRAWINGS

The foregoing and other objects and advantages of the invention will become apparent from the following detailed description and accompanying drawings, in which like reference characters designate like parts throughout the several views, and wherein.

DETAILED DESCRIPTION OF THE PREFERRED EMBODIMENTS

Figure 1:
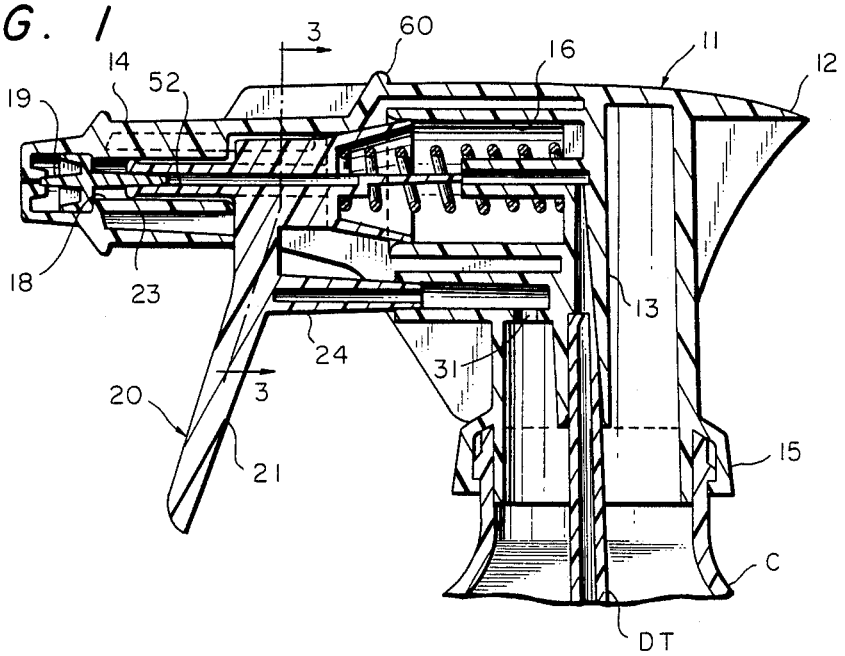
FIG. 1 is a vertical sectional view of a first form of the invention, shown fully assembled and attached to a container.
Figure 2:
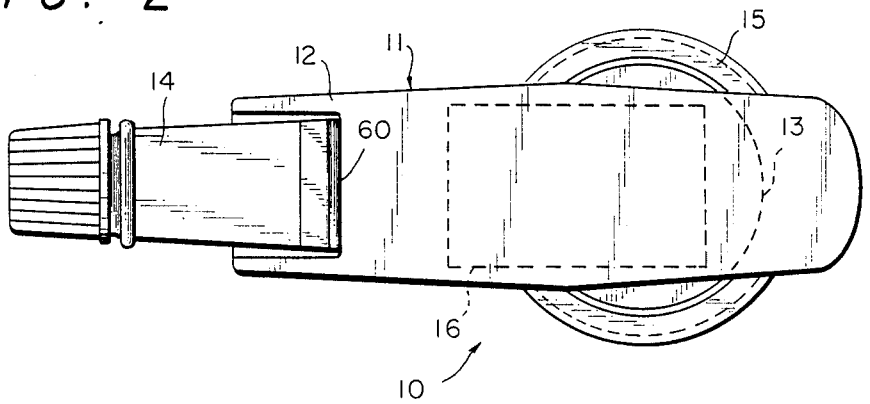
FIG. 2 is a top plan view of the trigger pump of FIG. 1.

Referring more specifically to the drawings, a first form of the invention is indicated generally at 10 in FIGS. 1–7. In this form of the invention, a single, integrally molded part 11 includes the shroud 12, housing 13, nose piece 14 and coupling ring 15 for attaching the pump assembly to a container. The housing includes a pump chamber 16 and a trigger guide and vent chamber 17 parallel to and beneath the pump chamber. An outlet chamber 18 is formed in the nose piece, and a nose piece valve 19, molded as a second part, is positioned in the outlet chamber.

A trigger actuator and pump unit 20 is molded as a third part, and includes a trigger 21, primary piston pump 22 reciprocable in the primary pump chamber 16, secondary piston 23 reciprocable in the outlet chamber 18, and vent valve 24 reciprocable in the vent chamber 17.

Figure 7:
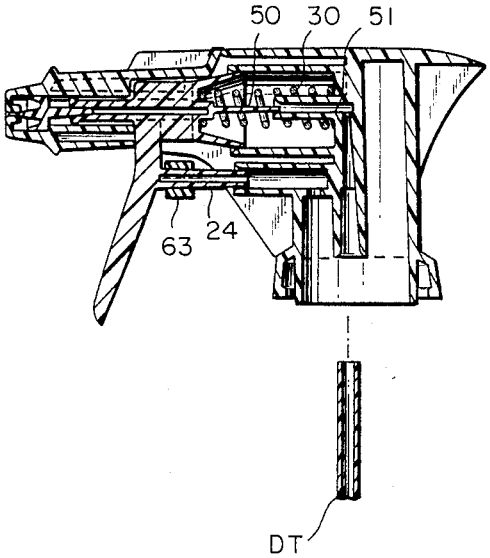
FIG. 7 is an exploded vertical sectional view of the assembled pump and a dip tube, showing the trigger in its normal, at-rest position.

Return spring 30 is engaged between the primary pump 22 and the bottom of primary pump chamber 16 for returning the trigger and pump unit 20 to its forward, at-rest position shown in FIGS. 1 and 7, and a dip tube DT is attached to the housing and extends into the container C for conveying product from the container and into the pump chamber when the piston 22 moves forwardly in the chamber 16. A vent opening 31 in the vent chamber 17 is controlled by the vent valve 24 in timed relationship to movement of the piston.

Figure 3:
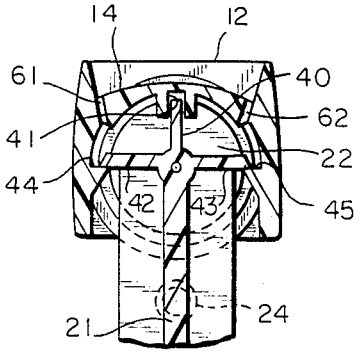
FIG. 3 is a transverse sectional view taken along line 3—3 in FIG. 1.
Figure 4:
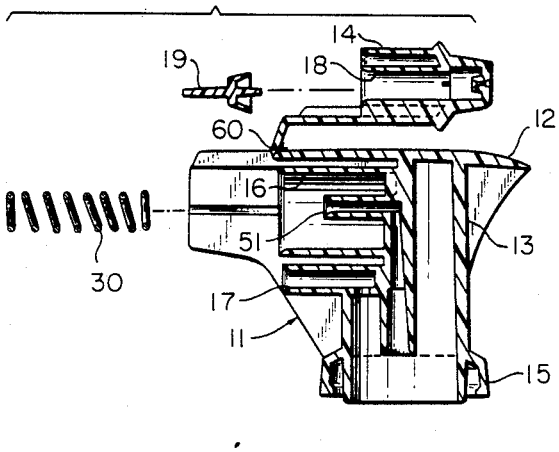
FIG. 4 is an exploded vertical sectional view of the shroud and nose piece, as molded, and the nose piece valve and return spring for the first form of the invention.
Figure 5:
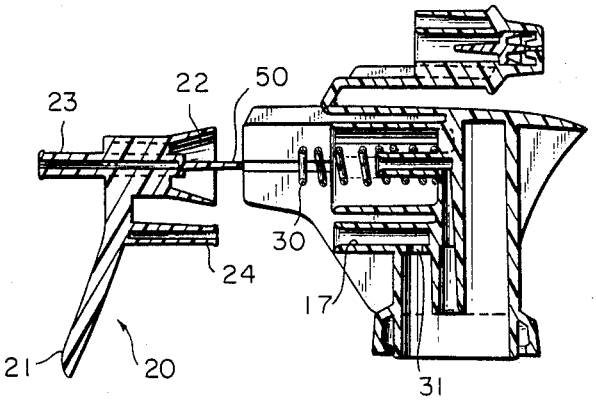
FIG. 5 is an exploded vertical sectional view similar to FIG. 4, showing the pump partially assembled.
Figure 6:
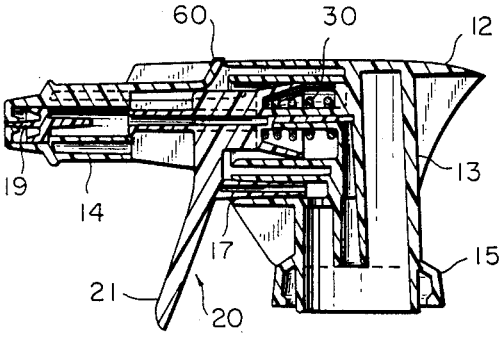
FIG. 6 is a vertical sectional view of the partially assembled pump, showing the trigger in a depressed position for pivoting of the nose piece into operative relationship with the shroud/housing.

With reference to FIGS. 1 and 3, movement of the pump in the housing is guided by an upstanding fin 40 formed on the pump piston 22 and sliding at its upper edge in a channel 41 on an inside top portion of the nose piece. In addition, a pair of horizontally projecting guide wings 42 and 43 extend from opposite sides of the piston and slide at their outer ends on shoulders 44 and 45 formed on the inside surfaces of the side walls of the shroud.

A valve pintle 50 projects rearwardly from the center of piston 22 and extends into an inlet passage 51 leading to the pump chamber for controlling flow therethrough. In this regard, the pintle serves to form a restricted passage, rather than completely closing off flow. Consequently, rapid rearward movement of the piston will result in product following the path of least resistance, i.e., forwardly through the piston to the outlet chamber. On the other hand, slow rearward movement of the piston and pintle will enable product to leak past the pintle and return to the container.

Alternatively, the pintle and/or inlet chamber could be modified to provide a sliding seal, whereby when the pintle enters the inlet passage flow through the passage is cut off, or the pintle and passage could be provided with means enabling flow to occur around the pintle during only part of its stroke in the passage. This last means could comprise, for example, serrations or other means in one of the pintle and passage wall enabling flow around the pintle.

In operation, the trigger is pulled rearwardly to move both the primary and secondary pistons 22 and 23, respectively, rearwardly, decreasing the volume of the pump chamber and enlarging the volume of the outlet chamber. Assuming that the pump has been previously primed, this action pressurizes the fluid in the pump chamber and causes it to flow forwardly through the passage 52 in the piston and into the outlet chamber behind the nose valve 19. When the pressure reaches a predetermined value, the flap of the nose valve opens and fluid is discharged through the nozzle. The nose valve prevents dribble of product from the dispenser as the pressure drops below a predetermined value. During the pressure stroke of the piston the vent valve 24 moves past the vent opening 31 and vents atmospheric pressure to the interior of the container.

It should be noted that as the pump is moved rearwardly, the pintle 50 enters inlet passage 51, restricting flow of fluid from the pump chamber back through the dip tube to the container. At the same time, the secondary piston 23 moves rearwardly in the outlet chamber 18, enlarging the volume of that chamber and tending to draw fluid through the piston from the pump chamber into the outlet chamber, at least partially overcoming the tendency of the fluid to flow back through the inlet passage. This action helps to maintain prime of the pump once established.

Assembly of the pump of the invention is illustrated in FIGS. 4–7. As shown in FIG. 7, the housing, nose piece and shroud unit 11 is molded as one piece with the nose piece displaced 180° about an integrally molded hinge 60. While in this "as molded" position, the nose valve 19 is inserted into the nose piece and the spring 30 is seated in the pump chamber. These assembly steps are accomplished at assembly station ONE. At assembly station TWO (FIG. 5), the trigger and pump unit 20 is placed in the pump chamber and depressed to the position shown in FIG. 6 (assembly station TWO-A). At this station the nose piece is pivoted downwardly about hinge 60 into its operative position in front of the trigger and pump assembly 20. In this position, the secondary piston 23 is aligned with the outlet chamber, whereby upon release of the trigger the spring 30 urges the trigger and pump unit forwardly with the outlet valve extended into the outlet chamber (see FIG. 7). The nose piece is held in its operative position by interengaged detents 61 and 62 on the nose piece and housing and shroud unit, respectively (FIG. 3). If desired, detents could be provided on other parts of the nose piece and shroud to hold the parts assembled, rather than use of the detents 61 and 62.

At assembly station THREE (FIG. 7), the dip tube DT is assembled to the housing. As shown in FIG. 7, a small split sleeve spacer 63 may be placed on the vent valve 24 to engage the forward end of the vent chamber and limit rearward movement of the trigger, thereby preventing withdrawal of the secondary piston completely out of the outlet chamber. Alternatively, stop detents (not shown) could be provided on the forward end of the secondary piston 23 and the rearward end of the outlet chamber to prevent withdrawal of the secondary piston completely from the outlet chamber. Other means, not shown, could be used to limit rearward movement of the piston and prevent withdrawal of the secondary piston from the outlet chamber, if desired.

The trigger pump thus described comprises only three molded parts (the shroud, housing, nose piece and coupling ring unit 11; nose valve 19; and trigger and pump unit 20) and two commercially purchased parts (the spring 30 and dip tube DT). This simple construction requires inventory of only a few parts, and assembly is accomplished with a minimal number of steps at only three stations. Manufacturing cost for the trigger pump of the invention is therefore reduced relative to prior art constructions.

The second form of the invention is indicated generally at 70 in FIGS. 8 through 12. In this form of the invention, a unique molding technique is used to mold the shroud 71 and nose piece 72 as a single unit. In this form, the nose piece is molded in its operative position for conventional assembly with a trigger unit and housing. In making the shroud and nose piece, a movable nose piece core 73 is slidable in the core 74 for forming the shroud (see FIG. 12). A horn pin 75 is connected between the nose piece core 73 and horn pin pocket cavity 76, and is disposed at an angle to the parting axis of the mold parts 74, 76. A slot 77 in the underside of core 74 provides clearance for fore and aft movement of the pin 75 as the core 74 and cavity 76 move toward and away from one another. As the cavity 76 moves up toward the core 74 the core 73 is caused to slide forwardly as shown in dot-and-dash lines in FIG. 12. Conversely, downward movement of cavity 76 retracts the core 73. Continued downward movement of the cavity 76 results in retracting the core 74 from the shroud. A guide pin 78 could be connected between the cavity 76 and core 74 to retract the mold from the molded parts. Means other than a horn pin could be used to cause fore and aft movement of the nose piece core in the shroud core as the cavity is moved toward and away from the shroud core, if desired.

Figure 8:
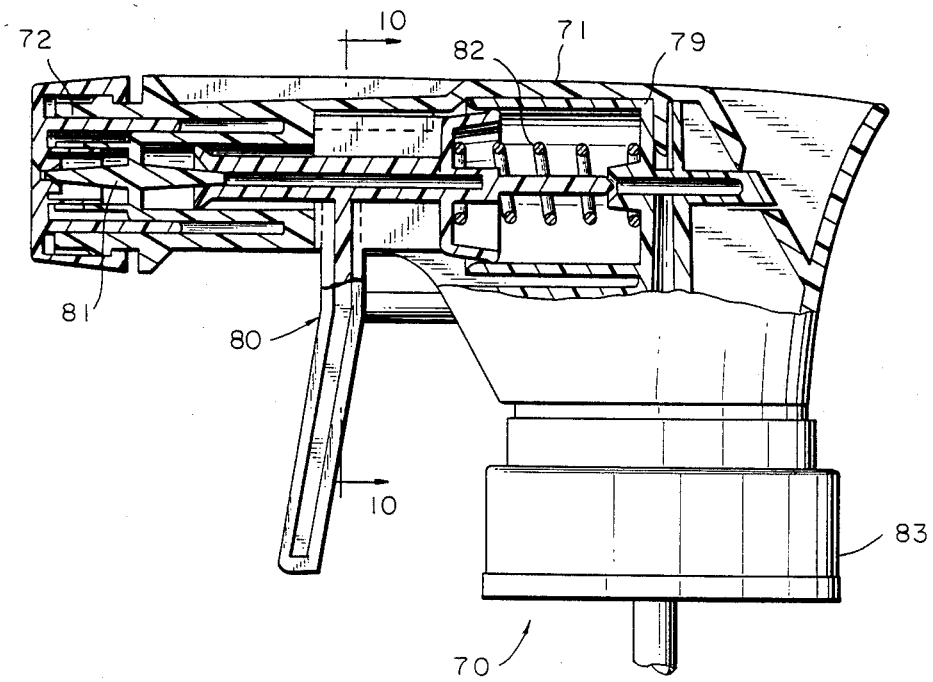
FIG. 8 is a partially sectional view of a second form of the invention, shown fully assembled.
Figure 9:
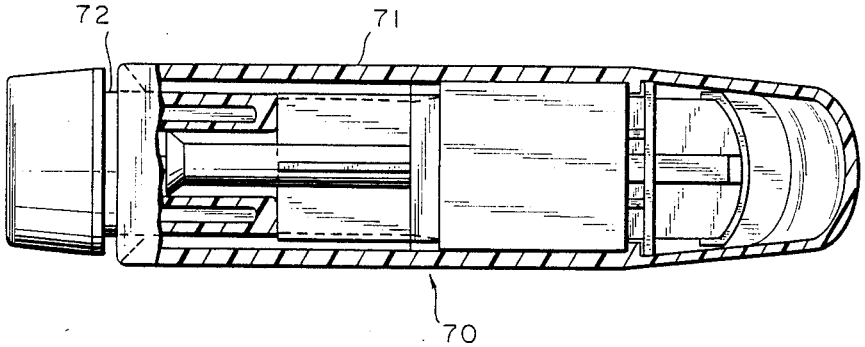
FIG. 9 is a top view shown partially in section of the second form of the invention.
Figure 10:
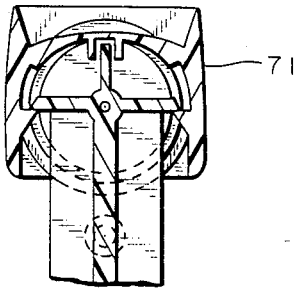
FIG. 10 is a transverse sectional view taken along line 10—10 in FIG. 8.
Figure 11:
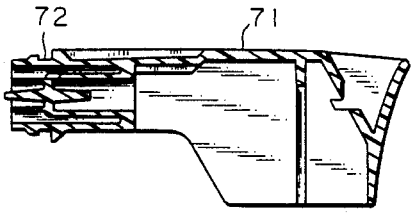
FIG. 11 is a vertical sectional view of the shroud and nose piece, as molded, of the second form of the invention.
Figure 12:
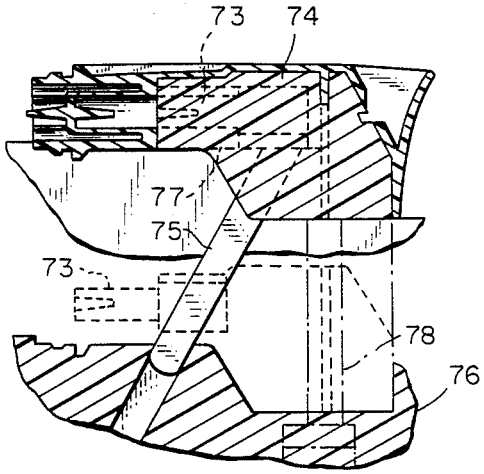
FIG. 12 is a somewhat schematic exploded vertical sectional view showing the relationship of mold core parts and shroud during manufacture of the second form of the invention.

A housing 79 is separately molded and then assembled to the shroud with a trigger unit 80, nose valve 81, return spring 82 and container coupling 83, all as shown in FIGS. 8, 9 and 10. The shroud 71 is secured to the housing through snap detents, or other conventional means, and the trigger is guided in its movement as more fully described in copending application Ser. No. 248,418. None of these features comprise a part of the present invention, however, and they will not be further described herein.

Figure 13:
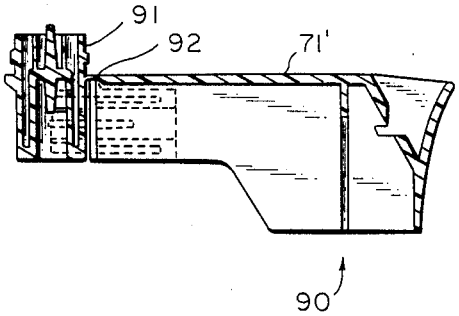
FIG. 13 is a vertical sectional view of a third form of the invention, shown in the "as molded" position.
Figure 14:
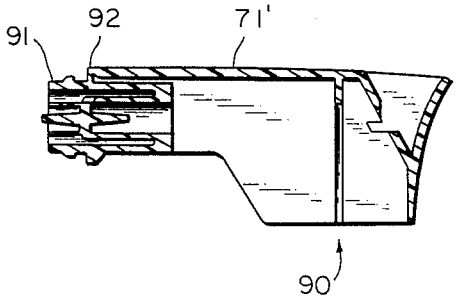
FIG. 14 is a vertical sectional view of the third form of the invention, showing the nose piece in its operative position.

A variation of this form of the invention is shown at 90 in FIG. 13, wherein the nose piece 91 is displaced through an angle of 90° during the molding process, and is then pivoted downwardly about molded hinge 92 into operative position as shown in FIG. 14. In this form of the invention, as in the first form described, the trigger assembly must be fully seated in the housing before the nose piece is pivoted into its operative position.

The form of the invention described first herein provides an economical and rugged trigger actuated pump which requires only three separate parts to be molded and inventoried, and assembly involves a minimal number of steps. The second described form of the invention enables a shroud and nose piece to be integrally molded according to a unique molding process. Common to all forms is the integral molding of a shroud and nose piece, with two of the forms joining the nose piece to the shroud via an integral hinge to facilitate manufacture and assembly of the pump. All forms of the invention are inexpensive to make, and the various pumps are intended to be disposable after the contents of the container are emptied.

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

I claim:

1. A trigger actuated pump for attachment to a container for dispensing fluid, comprising:

a shroud with a housing defining a pump chamber;

a trigger actuated pump means for pumping the fluid to be dispensed and including a primary piston reciprocable in the pump chamber;

a nose piece integrally molded with said shroud and defining a cylinder and nozzle means having a bore therethrough for passage of said pumped fluid;

a secondary piston rigidly connected with said primary piston, and reciprocable in said cylinder; and nose valve means in the cylinder for controlling flow of said fluid through said bore in the nozzle means responsive to the fluid pressures produced by the trigger actuated pump means, wherein said integrally molded shroud and nose section reduces the number of parts that need to be inventoried and simplifies assembly of the pump, thereby reducing the cost of the pump.

2. A trigger actuated pump as claimed in claim 1, wherein:

the nose piece is joined to the shroud via an integrally molded hinge, whereby the nose piece may be molded in a displaced position and then pivoted into operative position during assembly of the pump.

3. A trigger actuated pump as claimed in claim 1, wherein:

the nose piece is integrally molded to the shroud in its operative position.

4. A trigger actuated pump as claimed in claim 2, wherein:

the housing is integrally molded with the shroud as a single part.

5. A trigger actuated pump as claimed in claim 1, wherein:

the trigger actuated pump comprises a trigger and an integrally molded piston as a single, unitary part.

6. A trigger actuated pump as claimed in claim 5, wherein:

the housing is integrally molded with the shroud as a single part.

7. A trigger actuated pump as claimed in claim 6, wherein:

the means for securing the pump to a container comprises a coupling ring integrally molded with the shroud.

8. The method of manufacturing a trigger pump having a shroud, a housing, a nose piece, a nose valve, a trigger actuator, a piston pump, and a piston pump return spring, comprising the steps of:

integrally molding the shroud, housing and nose piece as a single part, with the housing having a pump chamber;

integrally molding the trigger actuator and pump piston as a single trigger pump unit;

placing the nose valve in the nose piece;

placing the return spring in the pump chamber of the housing; and inserting the trigger pump unit in the pump chamber against the return spring and engaging the trigger pump unit with the nose piece to hold the parts assembled.

9. The method of manufacturing a trigger pump as claimed in claim 8, wherein:

the housing is molded with an integral vent chamber adjacent the pump chamber;

the nose piece is molded with an integral outlet chamber adapted to be in alignment with the pump chamber when the pump is assembled; and the trigger unit is molded with an integral secondary piston for reciprocation in the outlet chamber and an integral vent valve for reciprocation in the vent chamber when the pump is assembled.

10. A trigger actuated pump for attachment to a container for dispensing fluid, comprising:

a shroud with a housing defining a pump chamber;

a trigger actuated pump means for pumping the fluid to be dispensed and including a piston reciprocable in the pump chamber;

means for attaching the pump to a container of fluid to be dispensed; and a nose piece integrally molded with said shroud and defining a cylinder therein, said nose piece having a bore therethrough for passage of said pumped fluid, said nose piece being joined to the shroud via an integrally molded hinge, whereby the nose piece may be molded in a displaced position and then pivoted into operative position during assembly of the pump, said integrally molded shroud and nose section reducing the number of parts that need to be inventoried and simplifying assembly of the pump, thereby reducing the cost of the pump.

11. A trigger actuated pump as claimed in claim 10, wherein:

said piston on the trigger actuated pump means comprises a primary piston slidable in the pump chamber defined in the housing; and a secondary piston pump is carried by the trigger actuated pump means for sliding engagement in the cylinder defined in the nose piece.

12. A trigger actuated pump as claimed in claim 10, wherein:

an inlet opening is formed in said housing for conveying material to be dispensed from a container to the pump chamber; and a restrictor means is carried by said pump means for cooperation with said inlet opening to control flow through the inlet opening upon actuation of the pump means.

13. A trigger actuated pump as claimed in claim 10, wherein:

said housing includes a vent chamber having a vent opening for communicating the interior of the container with the atmosphere; and a vent valve is carried by the trigger actuator for cooperation with the vent opening to control venting of the container upon actuation of the trigger actuator.

14. A trigger actuated pump as claimed in claim 13, wherein:

said vent valve is integrally formed with the trigger actuator.

15. A trigger actuated pump as claimed in claim 14, wherein:

said piston on the trigger actuated pump means comprises a primary piston slidable in the pump chamber defined in the housing; and a secondary piston pump is carried by the trigger actuated pump means for sliding engagement in the cylinder defined in the nose piece.

16. A trigger actuated pump as claimed in claim 15, wherein:

an inlet opening is formed in said housing for conveying material to be dispensed from a container to the pump chamber; and a restrictor means is carried by said pump means for cooperation with said inlet opening to control flow through the inlet opening upon actuation of the pump means.

17. A trigger actuated pump as claimed in claim 16, wherein:

the trigger actuated pump means comprises the primary piston and secondary piston arranged on a common axis for simultaneous reciprocation in the pump chamber and cylinder, respectively, and the vent valve extends parallel to but spaced from the primary and secondary pistons for reciprocation in the vent chamber simultaneously with reciprocation of the primary and secondary pistons.

18. A trigger actuated pump as claimed in claim 17, wherein:

the housing is integrally molded with the shroud as a single part.

19. A trigger actuated pump as claimed in claim 18, wherein:

the means for securing the pump to a container comprises a coupling ring integrally molded with the shroud.

* * * * *